US012378050B2

(12) United States Patent
Itano

(10) Patent No.: US 12,378,050 B2
(45) Date of Patent: Aug. 5, 2025

(54) PACKING CONTAINER

(71) Applicant: KYOCERA Document Solutions Inc., Osaka (JP)

(72) Inventor: Atsushi Itano, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 18/743,618

(22) Filed: Jun. 14, 2024

(65) Prior Publication Data

US 2024/0425253 A1 Dec. 26, 2024

(30) Foreign Application Priority Data

Jun. 21, 2023 (JP) ..... 2023-101682
Apr. 3, 2024 (JP) ..... 2024-060015

(51) Int. Cl.

| | |
|---|---|
| ***B65D 19/38*** | (2006.01) |
| ***B65D 61/00*** | (2006.01) |
| ***B65D 75/04*** | (2006.01) |
| ***B65D 75/58*** | (2006.01) |
| ***B65D 81/05*** | (2006.01) |
| ***B65D 81/107*** | (2006.01) |

(52) U.S. Cl.
CPC ..... *B65D 61/00* (2013.01); *B65D 75/04* (2013.01); *B65D 75/58* (2013.01); *B65D 81/058* (2013.01); *B65D 81/107* (2013.01); *B65D 19/38* (2013.01)

(58) Field of Classification Search
CPC ..... B65D 61/00; B65D 75/04; B65D 75/58; B65D 81/058; B65D 81/107; B65D 19/38
USPC ..... 206/386, 600
See application file for complete search history.

(56) References Cited

U.S. PATENT DOCUMENTS 6,105,511 A * 8/2000 Bridges ..... B65D 19/0026 312/265.5
6,585,126 B1 * 7/2003 Grigsby, Sr. ..... B65D 19/44 206/600
6,598,756 B1 * 7/2003 Rosenfeldt ..... B65D 85/68 217/15
8,381,929 B2 * 2/2013 Kellerer ..... B65D 11/1833 206/600
8,616,370 B2 * 12/2013 Allegretti ..... B65D 19/06 108/51.11

FOREIGN PATENT DOCUMENTS

JP 2006-096356 A 4/2006

* cited by examiner

*Primary Examiner* — Jacob K Ackun
(74) *Attorney, Agent, or Firm* — Stein IP, LLC

(57) ABSTRACT

A packing container includes a tray-fitted palette, a top case, a cushion member, and a slope plate. The tray-fitted palette has a tray on which a packed article is placed and a palette fixed to the bottom surface of the tray. The top case is in a tubular shape open at the bottom and covers the side and top faces of the packed article. The cushion member is placed between the packed article and the top case. When the packed article placed on the tray is moved, the slope plate is coupled to the tray-fitted palette. The cushion member is arranged as a reinforcement stand under the slope plate coupled to the tray-fitted palette.

14 Claims, 12 Drawing Sheets

PACKING CONTAINER

INCORPORATION BY REFERENCE

This application is based on and claims the benefit of priority from Japanese Patent Application No. 2023-101682 filed on Jun. 21, 2023 and Japanese Patent Application No. 2024-060015 filed on Apr. 3, 2024, the contents of both of which are hereby incorporated by reference.

BACKGROUND

The present disclosure relates to a packing container comprising a tray-fitted palette and a top box, and relates in particular to a packing container that co-packs a slope for moving a packed article from a product placement surface on a tray-fitted palette.

When a heavy product (packed article) such as an electronic appliance is transported and stored in a state packed on a tray-fitted palette covered with a top box (in a packing container), there is a height difference between the product placement surface of the tray-fitted palette and the floor level. It is thus common to arrange a slope over the height difference so that the product can be moved across the slope, if the product has casters, as it is and, if the product has no casters, placed on wheeled platform.

Here, inconveniently, if the slope is a plate-form member, a heavy product may cause the slope to sag, buckle, or break.

SUMMARY

According to one aspect of the present disclosure, a packing container includes a tray-fitted palette, a top case, a cushion member, and a slope plate. The tray-fitted palette has a tray on which a packed article is placed and a palette fixed to the bottom surface of the tray. The top case is in a tubular shape open at the bottom and covers the side and top faces of the packed article. The cushion member is placed between the packed article and the top case. When the packed article placed on the tray is moved, the slope plate is coupled to the tray-fitted palette. The cushion member is arranged as a reinforcement stand under the slope plate coupled to the tray-fitted palette.

DETAILED DESCRIPTION

Figure 1:
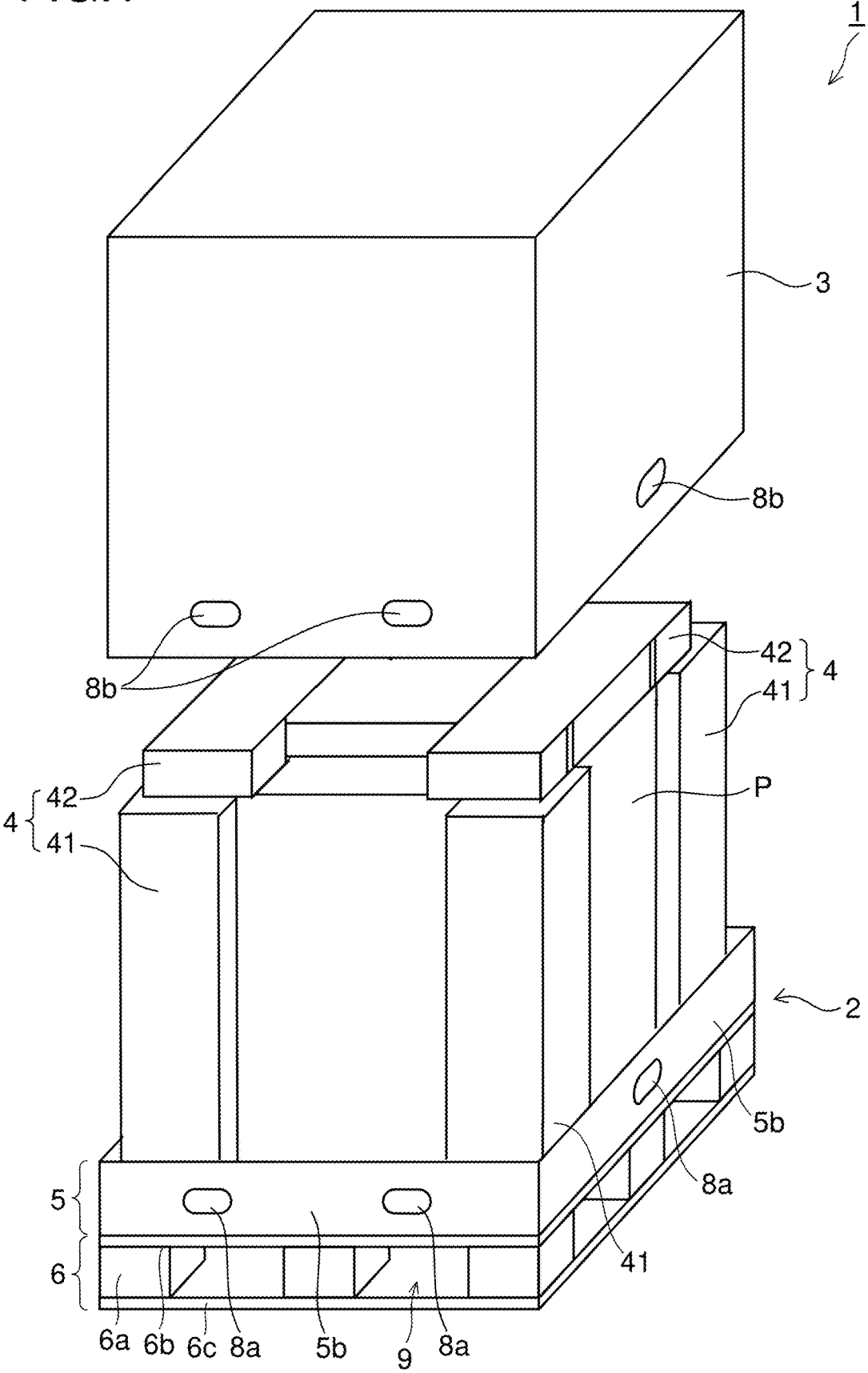
FIG. 1 is a perspective view showing a packing container according to a first embodiment of the present disclosure, with a product placed in it.

Embodiments of the present disclosure will be described below with reference to the accompanying drawings. FIG. 1 is a perspective view of a packing container 1 according to a first embodiment of the present disclosure, with a product P placed in it. As shown in FIG. 1, the packing container 1 includes a tray-fitted palette 2, a top case 3, and a cushion member 4.

The tray-fitted palette 2 includes a tray 5 and a palette 6 fixed to the bottom surface of the tray 5. The tray 5 has a rectangular floor surface 5*a* (see FIG. 2) on which to place the product P, and four flaps 5*b* coupled to the four sides of the floor surface 5*a*. The flaps 5*b* have through holes 8*a* formed in them at predetermined places.

The palette 6 is composed of a plurality of columns 6*a* formed, for example, by folding cardboard and a top plate 6*b* and a bottom plate 6*c* that are fixed to the top and bottom faces of the columns 6*a*. Between the columns 6*a*, arm insertion slots 9 are formed to permit insertion of the arms of a fork lift or hand palette (wheeled platform for transporting a palette). The top plate 6*b* is fastened to the bottom surface 5*a* of the tray 5 with nails, screws, or the like (not illustrated). The palette 6 can be made of wood.

The tray-fitted palette 2 serves as the floor surface of the packing container 1. Thus, once the product P is packed, there is no need to place the packing container 1 on a palette.

This makes it easy to pack and transport, in particular, a large-size product or the like.

The top case 3 has the shape of a rectangular parallelepiped open at the bottom, and covers the side and top faces of the product P (packed article). In a bottom end part of the top case 3, at positions overlapping with the through holes 8*a* in the flaps 5*b*, through holes 8*b* are formed. With the through holes 8*a* and 8*b* aligned with each other, inserting fastening members in them permits the tray-fitted palette 2 and the top case 3 to be coupled together into a single body. While in this embodiment a top case 3 having a tubular side part and a top part formed integrally is used, instead a top case 3 having a side part and a box-form top part formed separably can be used.

The cushion member 4 is arranged in a gap between the product P and the top case 3 and protects the product P from external impact. The cushion member 4 is formed by folding a cardboard sheet into a predetermined shape. The cushion member 4 includes side cushion members 41 arranged at the side of the product P and top cushion members 42 arranged at the top of the product P.

The side cushion members 41 are arranged along the up-down direction so as to cover the four corners of the side of the product P. Between the side cushion members 41 and the flaps 5*b*, a predetermined gap is left and, in this gap, the bottom end part of the top case 3 is inserted. The top cushion members 42, two of them, are arranged parallel to each other at the top of the product P. The structure of the top cushion members 42 will be described in detail later.

Figure 2:
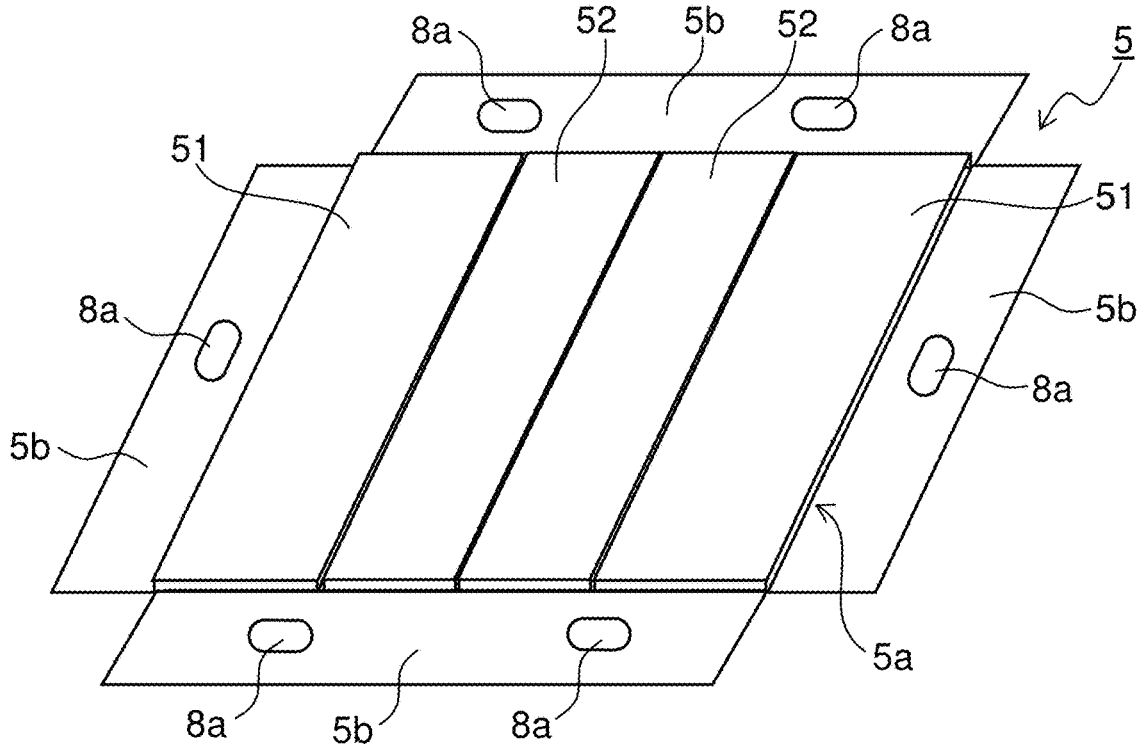
FIG. 2 is a perspective view of a tray of a tray-fitted palette in the packing container of this embodiment.

FIG. 2 is a perspective view of the tray 5 as a part of the tray-fitted palette 2 of the packing container 1 of the first embodiment. As shown in FIG. 2, the floor surface 5*a* of the tray 5 has laid on it a pair of support plates 51 and a pair of slope plates 52.

The support plates 51 are fixed to the floor surface 5*a* along two opposite sides (the left and right sides in FIG. 2) of the floor surface 5*a*. The support plates 51 lie opposite casters 60 (see FIG. 9) provided in the four corners of the product P. The slope plates 52 are arranged parallel to each other between the pair of support plates 51. The slope plates 52 are removably fitted to the floor surface 5*a*.

Figure 3:
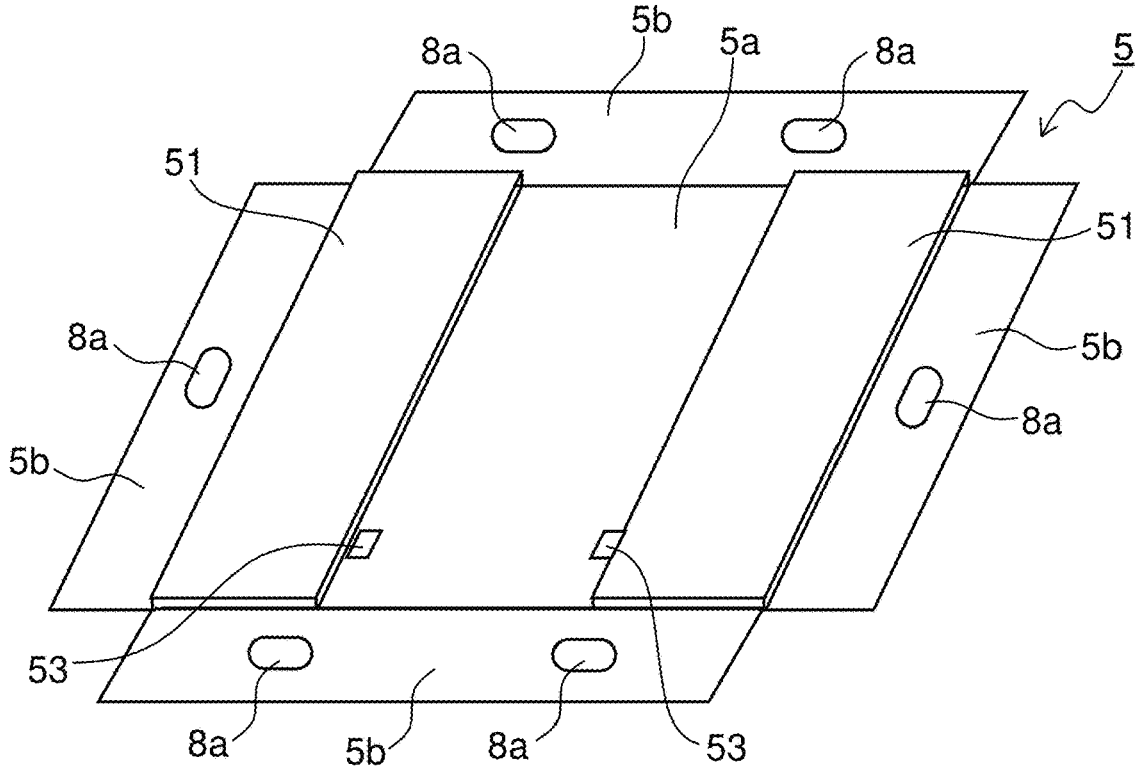
FIG. 3 is a perspective view of the tray in FIG. 2, with slope plates removed.
Figure 4:
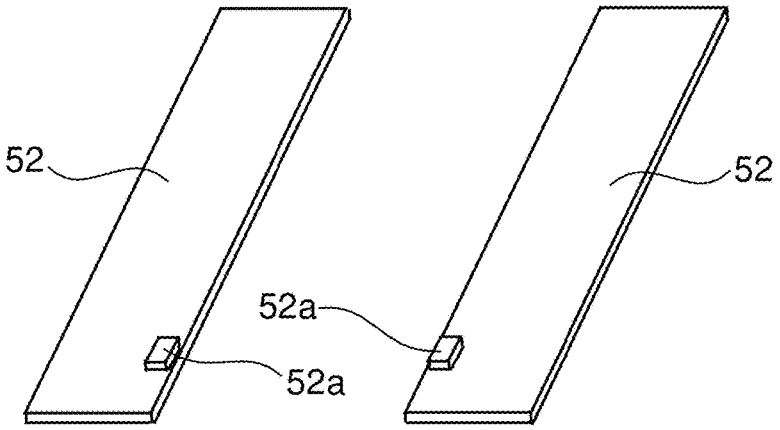
FIG. 4 is a perspective view of the slope plates as seen from their bottom side.

FIG. 3 is a perspective view of the tray 5 in FIG. 2 with the slope plates 52 removed. FIG. 4 is a perspective view of the slope plates 52 as seen from their bottom side. As shown in FIG. 3, in the parts of the floor surface 5*a* over which the slope plates 52 are laid, two engagement holes 53 are formed. As shown in FIG. 4, on the bottom side of the slope plates 52, positioning projections 52*a* are formed respectively.

When the slope plates 52 are laid on the floor surface 5*a* of the tray 5, the positioning projections 52*a* formed on the bottom side of the slope plates 52 fit in the engagement holes 53 in the floor surface 5*a*. This permits the slope plates 52 to be attached accurately at a predetermined position on the floor surface 5*a*. It is also possible to prevent displacement or dropping-off of the slope plates 52 under vibration and impact during transport.

Figure 5:
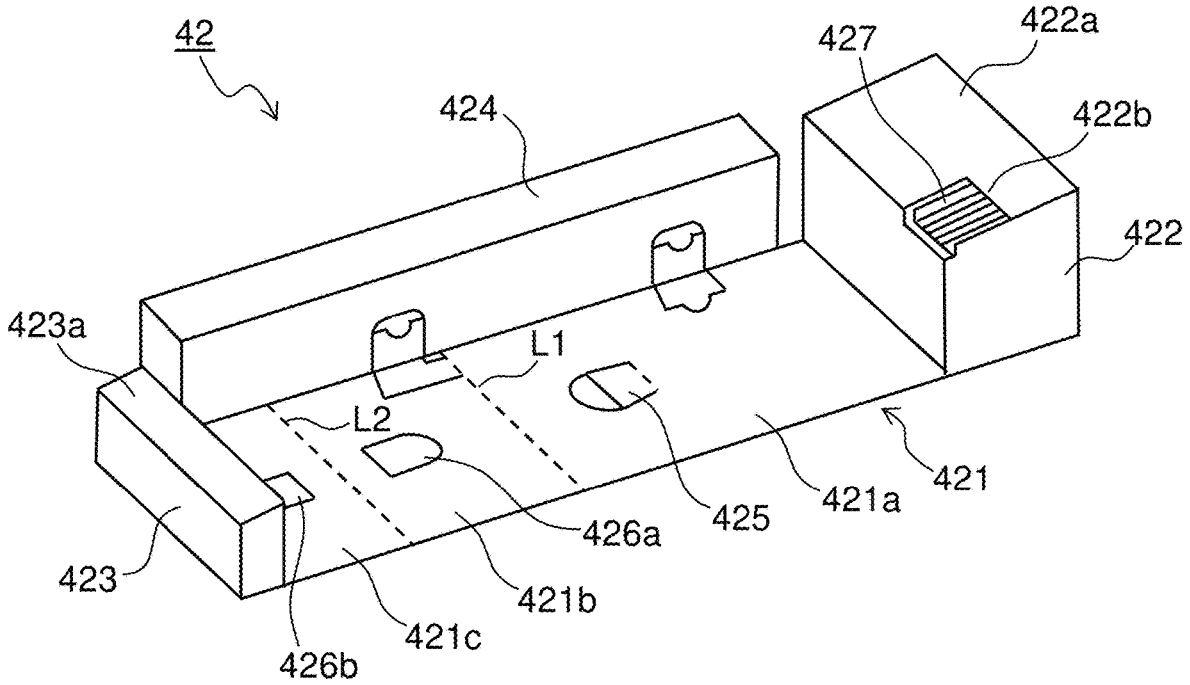
FIG. 5 is a perspective view of a top cushion member placed on the top of the product, as seen from the side of contact with the product.

FIG. 5 is a perspective view of the top cushion member 42 placed on the top of the product P, as seen from the side of contact with the product P. The top cushion member 42 is formed by folding a sheet material such as a cardboard sheet. The top cushion member 42 has a cushion plate 421, a first column 422, a second column 423, and a third column 424.

The cushion plate 421 is in a rectangular shape, and is divided by folding lines L1 and L2 into a first region 421*a*, a second region 421*b*, and a third region 421*c*. In the first region 421*a*, an insertion tab 425 is formed. In the second and third regions 421*b* and 421*c*, insertion holes 426*a* and 426*b* are formed respectively.

The first column 422 is formed either by folding a sheet material provided contiguously with the first region 421*a* side edge of the cushion plate 421 into a square tubular shape or by folding and bonding another sheet material. At the tip end (top face in FIG. 5) of the first column 422, an inclined surface 422*a* is formed that inclines downward toward the second column 423. In the inclined surface 422*a*, an opening 422*b* is formed. The inside of the first column 422 is filled with a reinforcement member 427 formed by stacking together cardboard sheets in the horizontal direction.

The reinforcement member 427 has the cardboard sheets stacked together such that the grain direction of the cardboard sheets (i.e., the extension direction of the veins formed by their flat and corrugated segments) run in the vertical direction. Thus, when as will be described later the top cushion members 42 is used as a reinforcement stand for the slope plates 52, the reinforcement member 427 is less likely to buckle, giving the first column 422 increased strength. Also, when the top cushion member 42 is placed on the top of the product P, the first column 422 exhibits increased cushioning properties against impact from the side.

The second column 423 is formed either by folding a sheet material provided contiguously with the third region 421*c* side edge of the cushion plate 421 into a square tubular shape or by folding and bonding another sheet material. The height of the second column 423 is smaller than that of the first column 422. At the tip end (top face in FIG. 5) of the second column 423, an inclined surface 423*a* is formed that inclines in the same direction as the inclined surface 422*a* of the first column 422. The inclination angle of the inclined surfaces 422*a* and 423*a* is approximately equal to the inclination angle of the slope plates 52 as it is when these are used.

The third column 424 is formed either by folding a sheet material provided contiguously with the edge of the first region 421*a* of the cushion plate 421 orthogonal to the first column 422 into a square tubular shape or by folding and bonding another sheet material. The third column 424 is arranged orthogonal to the first and second columns 422 and 423, along the approximately entire edge of the cushion plate 421 from the first column 422 to the second column 423. The height of the third column 424 is smaller than that of the first column 422, and is larger than that of the second column 423.

In the packing container 1 of this embodiment, when the product P is moved from the tray-fitted palette 2 using the slope plates 52, the top cushion member 42 can be used as a reinforcement stand for the slope plates 52. Here, in the top cushion member 42 shaped as shown in FIG. 5 (first shape), the interval between the first and second columns 422 and 423 is set to suit the shape of the top of the product P. Accordingly, when the top cushion member 42 is used as a reinforcement stand, the interval between the first and second columns 422 and 423 needs to be adjusted.

Figure 6:
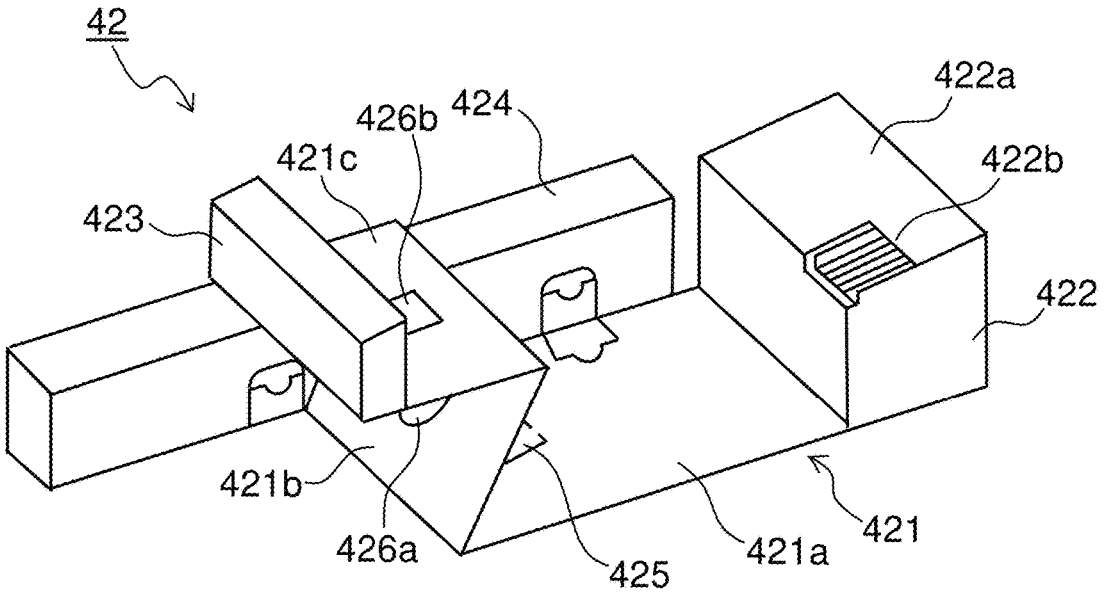
FIG. 6 is a perspective view of the top cushion member, with its cushion surface folded from the state in FIG. 5.
Figure 7:
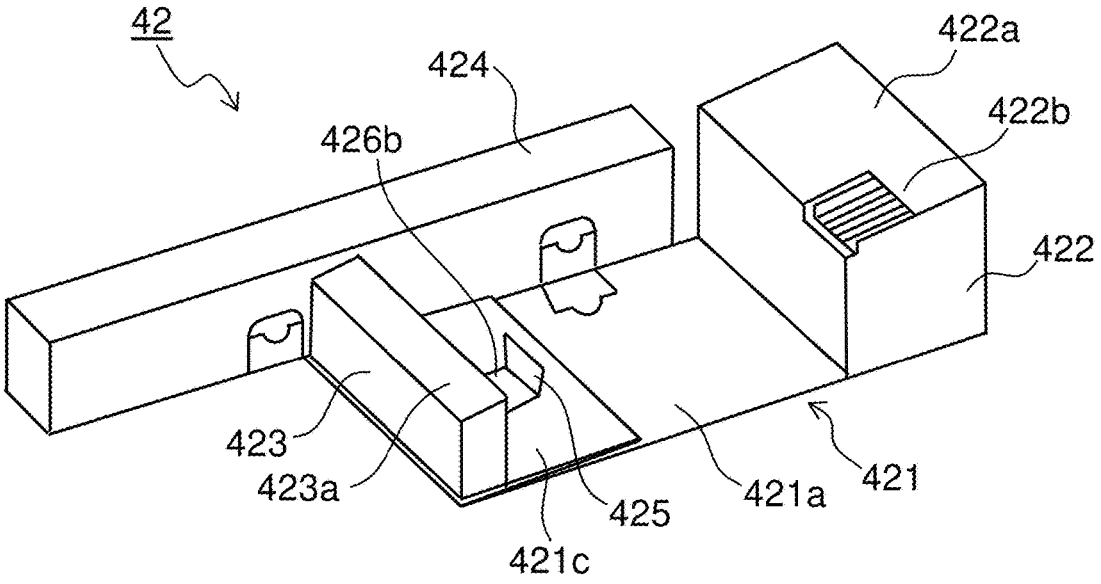
FIG. 7 is a perspective view of the top cushion member, with its cushion surface folded up from the state in FIG. 6 and fastened with an insertion tab.

FIGS. 6 and 7 are diagrams showing the procedure of folding the top cushion member 42 when it is used as a reinforcement stand for the slope plates 52. When the top cushion member 42 is used as a reinforcement stand, as shown in FIG. 6, the cushion plate 421 is valley-folded along the folding line L1 and is then mountain-folded along the folding line L2. Thus the first, second, and third regions 421*a*, 421*b*, and 421*c* of the cushion plate 421 are folded into a Z-shape as seen from the side.

Then, as shown in FIG. 7, the second and third regions 421*b* and 421*c* are laid on the first region 421*a*. When this is done, the insertion hole 426*a* in the second region 421*b* and the insertion hole 426*b* in the third region 421*c* overlap with each other. Then, inserting the insertion tab 425 of the first region 421*a* into the insertion holes 426*a* and 426*b* permits the cushion plate 421 to be held in a folded-up state. In the top cushion member 42 shaped as shown in FIG. 7 (second shape), the interval between the first and second columns 422 and 423 is such that, when the top cushion member 42 is used as a reinforcement stand for the slope plates 52, the inclined surface 422*a* of the first column 422 and the inclined surface 423*a* of the second column 423 make surface contact with the bottom surfaces of the slope plates 52.

Specifically, according to whether the cushion plate 421 is folded up along the folding lines L1 and L2 (first folding lines) perpendicular to the extension direction of the slope plates 52 or is unfolded from the folded-up state, a choice is possible between the shape in FIG. 5 (first shape) where the interval between the first and second columns 422 and 423 is set to suit the shape of the product P and the shape in FIG. 7 (second shape) where the interval between the first and second columns 422 and 423 is set to suit use as a reinforcement stand for the slope plates 52.

Figure 8:
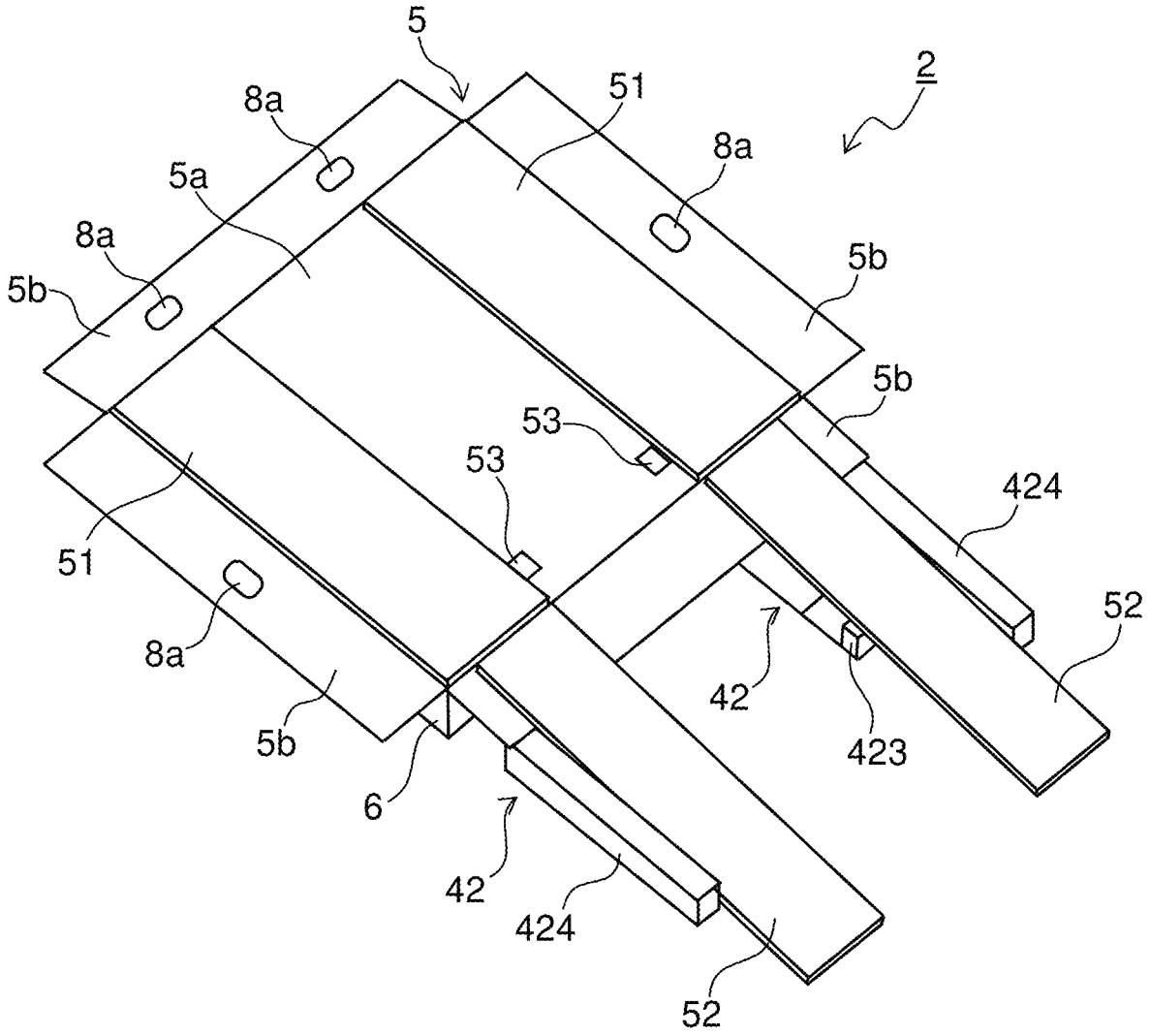
FIG. 8 is a perspective view of the packing container of the first embodiment, with the slope plates removed from the tray of the tray-fitted palette and coupled to a flap and the top cushion members placed under the slope plates.
Figure 9:
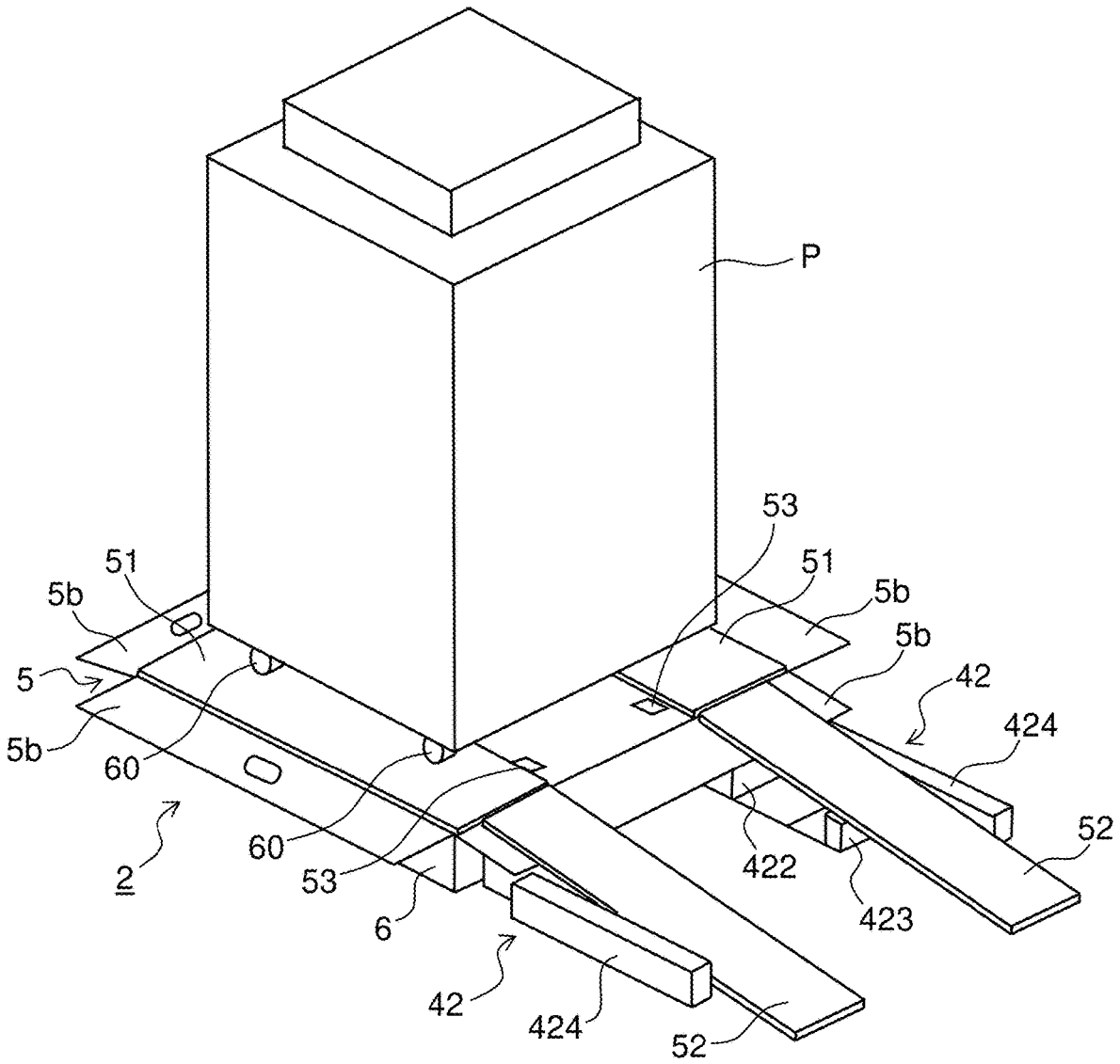
FIG. 9 is a perspective view showing how the product is moved from the tray-fitted palette using the slope plates.

FIG. 8 is a perspective view of the packing container 1 of the first embodiment, with the slope plates 52 removed from the tray 5 of the tray-fitted palette 2 and coupled to the flaps 5*b* and the top cushion members 42 placed as a reinforcement stand under the slope plates 52. FIG. 9 is a perspective view showing how the product P is moved from the tray-fitted palette 2 using the slope plates 52. Now, with reference to FIGS. 8 and 9, the procedure of unpacking the packing container 1 and taking out the product P will be described.

To unpack the packing container 1, the fastening members (unillustrated) inserted in the through holes 8*a* and 8*b* are removed and then the top case 3 (see FIG. 1) is removed. Then the side cushion members 41 and the top cushion members 42 are removed and the flaps 5*b* are collapsed outward.

Next, the slope plates 52 are removed from the floor surface 5*a* of the tray 5. The casters 60 of the product P are placed on the support plates 51 and thus the slope plates 52 do not bear the load of the product P. The casters 60 leave a gap between the slope plates 52 and the product P. Thus, by lifting the slope plates 52 so as to release the engagement between the positioning projections 52*a* (see FIG. 4) and the engagement holes 53 in the floor surface 5*a* and then pulling them out in the horizontal direction, the slope plates 52 can be removed easily.

Next, the slope plates 52 thus removed are coupled to the tray-fitted palette 2 and, under the slope plates 52, the top cushion members 42 are placed as a reinforcement stand. Specifically, the positioning projections 52*a* on the slope plates 52 are fitted into the through holes 8*a* in the flaps 5*b*. Thus the slope plates 52 are positioned relative to the tray-fitted palette 2.

Next, the top cushion members 42 folded as shown in FIG. 7 are, with the cushion plates 421 facing down, placed under the slope plates 52. The cushion members 42 are arranged with the first columns 422 located close to the tray-fitted palette 2 and the second columns 423 located away from the tray-fitted palette 2. In this state, the positioning projections 52*a* on the slope plates 52 are fitted through the through holes 8*a* into the openings 422*b* formed in the first columns 422 of the top cushion members 42.

Thus, the slope plates 52 and the top cushion members 42 are positioned relative to each other, and the inclined surfaces 422*a* and 423*a* of the first and second columns 422 and 423 make surface contact with the bottom surfaces of the slope plates 52. The third columns 424 are arranged along the outer edges of the slope plates 52. Parts of the third columns 424 protrude upward beyond the slope plates 52. Now, a slope leading from the tray-fitted palette 2 to the floor level is ready.

Then, as shown in FIG. 9, the casters 60 of the product P are moved from the support plates 51 to the slope plates 52 so that the product P can be moved from the tray-fitted palette 2 to the floor level across the slope plates 52.

In this embodiment, the top cushion members 42 are used as a reinforcement stand for the slope plates 52. This eliminates the need to co-pack a separate member as a reinforcement stand, and thus helps reduce the volume of the packing container 1. Transport and storage are then possible with the minimum packing volume, and this helps reduce transport and storage costs. The amounts of materials used to produce the packing container 1 itself can also be reduced, and this helps reduce the cost of the packing container 1. There is no longer the need for a member used as a slope only when the packing container 1 is unpacked. This helps reduce the amounts of materials collected and discarded from a used packing container 1 and is therefore environment-friendly.

The top cushion members 42 permit, through the folding of the cushion plates 421, the interval between the first and second columns 422 and 423 to be changed. Thus the interval between the first and second columns 422 and 423 can be adjusted appropriately between when the top cushion members 42 are used as a cushion member and when they are used as a reinforcement stand for the slope plates 52.

When the cushion members 42 are placed under the slope plates 52, the third columns 424 are arranged along the outer edges of the slope plates 52 and parts of the third columns 424 protrude upward beyond the slope plates 52. Thus the third columns 424 serve as guides that prevent the casters 60 from falling off the slope plates 52.

The slope plates 52 are packed in a state laid on the floor surface 5*a* of the tray 5. This eliminates the need for a packing space for the slope plates 52. Engaging the positioning projections 52*a* on the slope plates 52 with the engagement holes 53 in the floor surface 5*a* helps prevent displacement or dropping-off of the slope plates 52.

Fitting the positioning projections 52*a* on the slope plates 52 into the through holes 8*a*, for fastening members, formed in the flaps 5*b* of the tray 5 and into the openings 422*b* formed in the first columns 422 of the cushion members 42 permits easy positioning of the slope plates 52 relative to the tray 5 and the slope plates 52.

Figure 10:
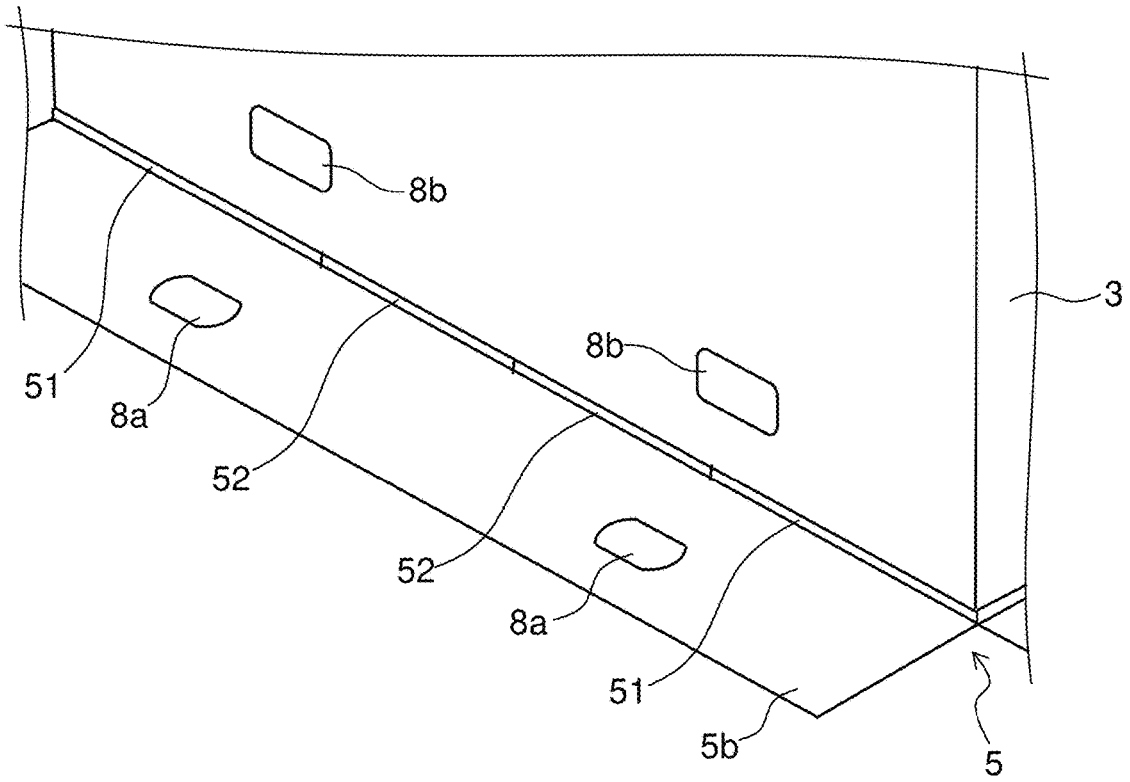
FIG. 10 is an enlarged perspective view of a part of the packing container of the first embodiment where the tray and a bottom end part of the top case make contact with each other.

When the slope plates 52 are laid on the floor surface 5*a* of the tray 5, the top surfaces of the support plates 51 and the top surfaces of the slope plates 52 are flush with each other. Thus, when the top case 3 is placed over the tray 5, as shown in FIG. 10, no gap is left from the bottom edge of the top case 3 to the support plates 51 and the slope plates 52. This helps exploit the strength of the top case 3 with no loss, and thus helps prevent buckling of the top case 3 when the packing container 1 having the product P packed in it is stacked on another.

Figure 11:
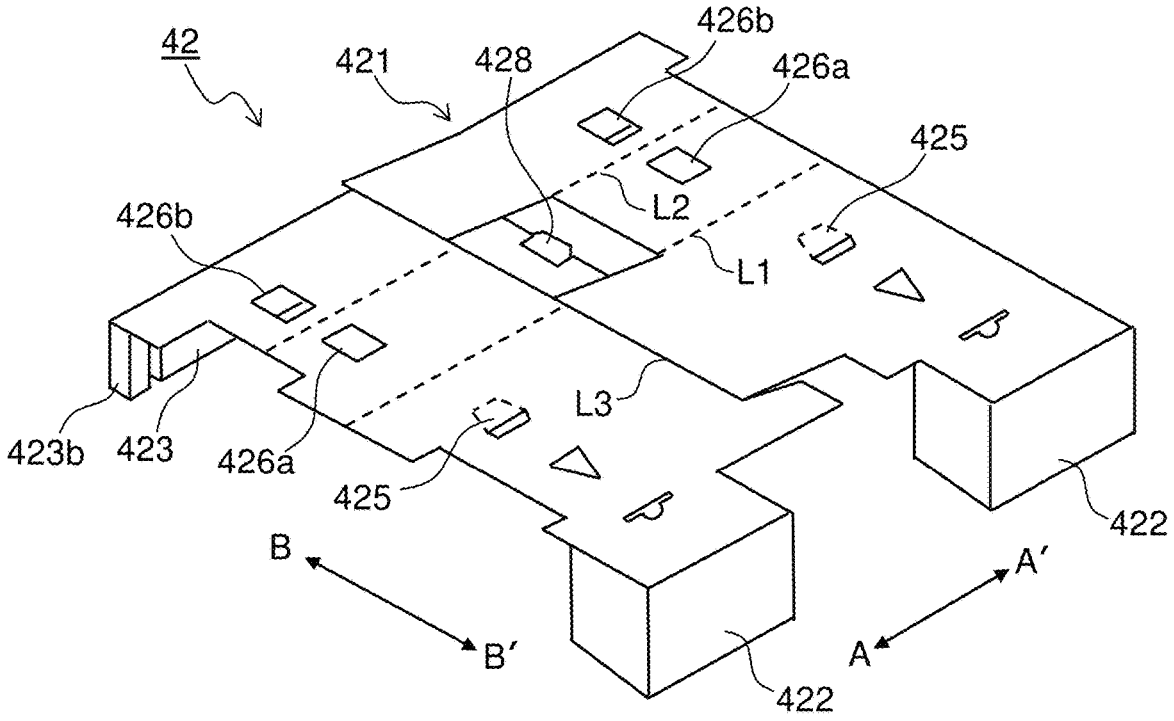
FIG. 11 is a perspective view of a top cushion member used in a packing container according to a second embodiment of the present disclosure, as seen from above.
Figure 12:
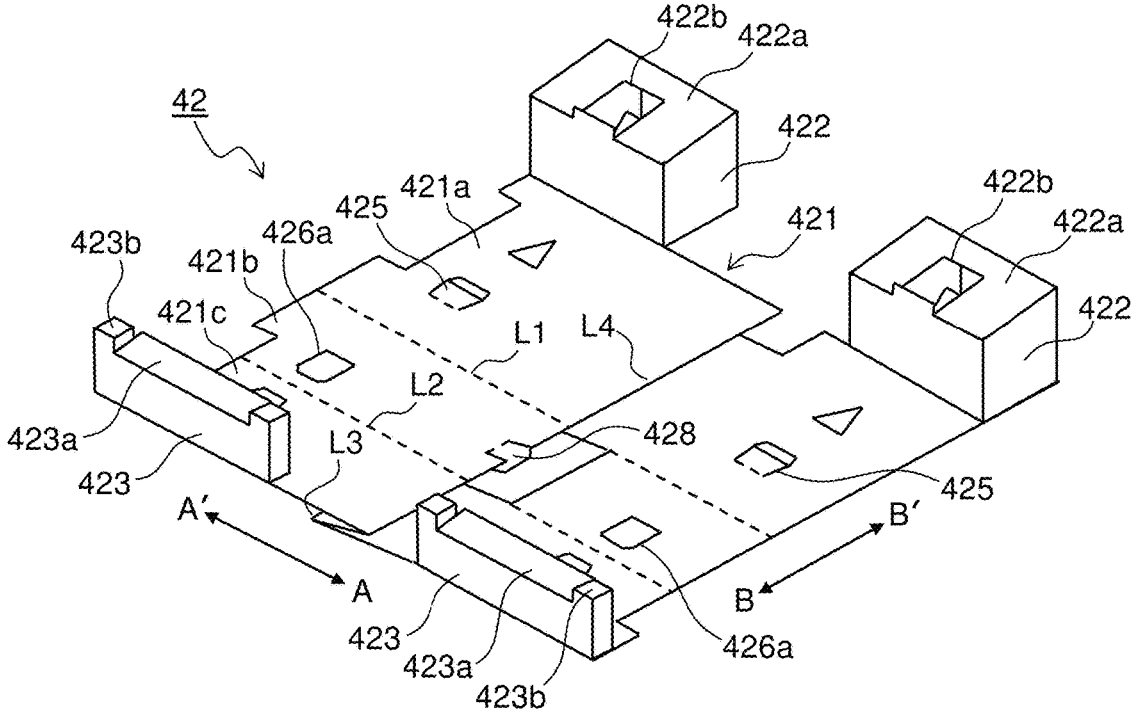
FIG. 12 is a perspective view of the top cushion member used in the packing container of the second embodiment, as seen from the side of contact with a product.

FIG. 11 is a perspective view of a top cushion member 42 used in a packing container 1 according to a second embodiment of the present disclosure, as seen from above. FIG. 12 is a perspective view of the top cushion member 42 used in the packing container 1 according to the second embodiment, as seen from the side of contact with the product P. In FIGS. 11 and 12, and also in the diagrams referred to later, the horizontal direction orthogonal to the extension direction of the slope plates 52 with the top cushion member 42 arranged as a reinforcement stand under the slope plates 52 is referred to as the first direction (arrow AA' direction). The extension direction of the slope plates 52 (i.e., the horizontal direction orthogonal to the first direction) is referred to as the second direction (arrow BB' direction).

In this embodiment, one top cushion member 42 as shown in FIGS. 11 and 12 is arranged in the gap between the top of the product P and the top case 3. The top cushion member 42 is formed by folding a sheet material such as a cardboard sheet. The top cushion member 42 has a cushion plate 421, a pair of first columns 422, and a pair of second columns 423.

The cushion plate 421 is in a rectangular shape, and is divided by folding lines L1 and L2 parallel to the first direction into a first region 421*a*, a second region 421*b*, and a third region 421*c*. Moreover, the cushion plate 421 is folded up into a Z-shape as seen from the side along folding lines L3 and L4 (second folding lines) parallel to the second direction. Folding up the cushion plate 421 along the folding lines L3 and L4 permits the interval between the pair of first columns 422 and the interval between the pair of second columns 423 to be adjusted to suit the size of the product P. The second region 421*b* is provided with a locking mechanism 428. The locking mechanism 428 comprises a tab and a slit, and inserting the tab into the slit permits the cushion plate 421 to be held in a state folded up along the folding lines L3 and L4.

The pair of first columns 422 is formed either by folding a sheet material provided contiguously with the first region 421*a* side edge of the cushion plate 421 into a square tubular shape or by folding and bonding another sheet material. Otherwise the first columns 422 are structured as in the first embodiment and no overlapping description will be repeated.

The pair of second columns 423 is formed either by folding a sheet material provided contiguously with the third region 421*c* side edge of the cushion plate 421 into a square tubular shape or by folding and bonding another sheet material. The height of the second columns 423 is smaller than that of the first columns 422. At the tip ends (top faces in FIG. 12) of the pair of second columns 423, pairs of guides 423*b* are respectively formed that protrude upward from opposite end parts of those tip ends in the first direction. The interval between each pair of guides 423*b* is slightly larger than the width of the slope plate 52. When the top cushion member 42 is placed under the slope plates 52, the slope plates 52 engage between the pairs of guides 423*b*. Otherwise the second columns 423 are structured as in the first embodiment and no overlapping description will be repeated.

Now, the procedure of unpacking the packing container 1 of the second embodiment and taking out the product P will be described. How the top case 3 is removed from the tray-fitted palette 2 and how the slope plates 52 are removed from the tray 5 are similar to how they are handled in the first embodiment.

Figure 13:
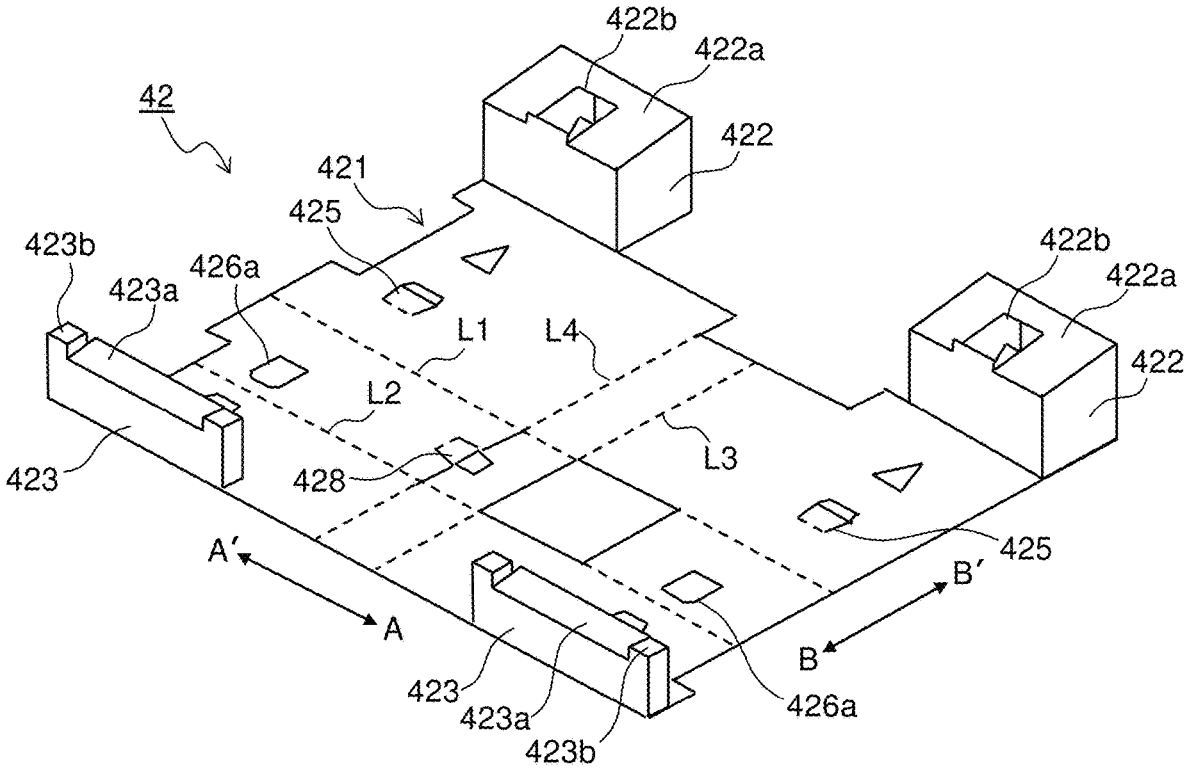
FIG. 13 is a perspective view of the top cushion member, with a folded-up part of its cushion surface unfolded from the state in FIG. 12.

Next, the top cushion member 42 is reshaped from the shape in FIGS. 12 and 13 (first shape) set to suit the shape of the product P to the shape (second shape) set to suit use as a reinforcement stand for the slope plate 52.

Specifically, from the state shown in FIG. 12 where the cushion plate 421 is folded up in the first direction along the folding lines L3 and L4, the locking mechanism 428 is released so that the cushion plate 421 is unfolded into a flat state as shown in FIG. 13. Thus the intervals between the pair of first columns 422 and between the pair of second columns 423 are adjusted to suit use as a reinforcement stand for the slope plates 52.

Figure 14:
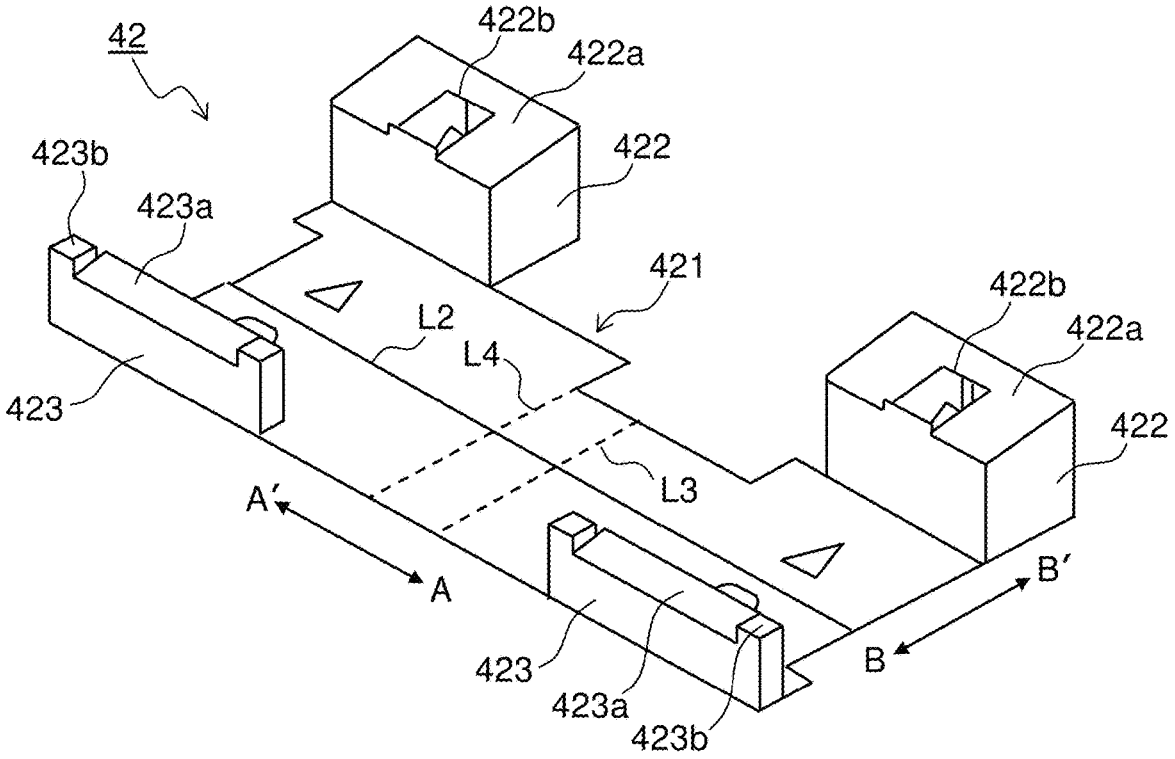
FIG. 14 is a perspective view of the top cushion member, with its cushion surface folded up along folding lines from the state in FIG. 13.

Next, from the state in FIG. 13, the cushion plate 421 is folded along the folding lines L1 and L2 into a Z-shape as seen from the side and the insertion tabs 425 of the first region 421*a* are inserted into the insertion holes 426*a* and 426*b* (for these, see FIG. 11) so that the cushion plate 421 is held in a state folded-up in the second direction as shown in FIG. 14. In this way, the interval from the first columns 422 to the second columns 423 is adjusted to suit use as a reinforcement stand for the slope plates 52.

Figure 15:
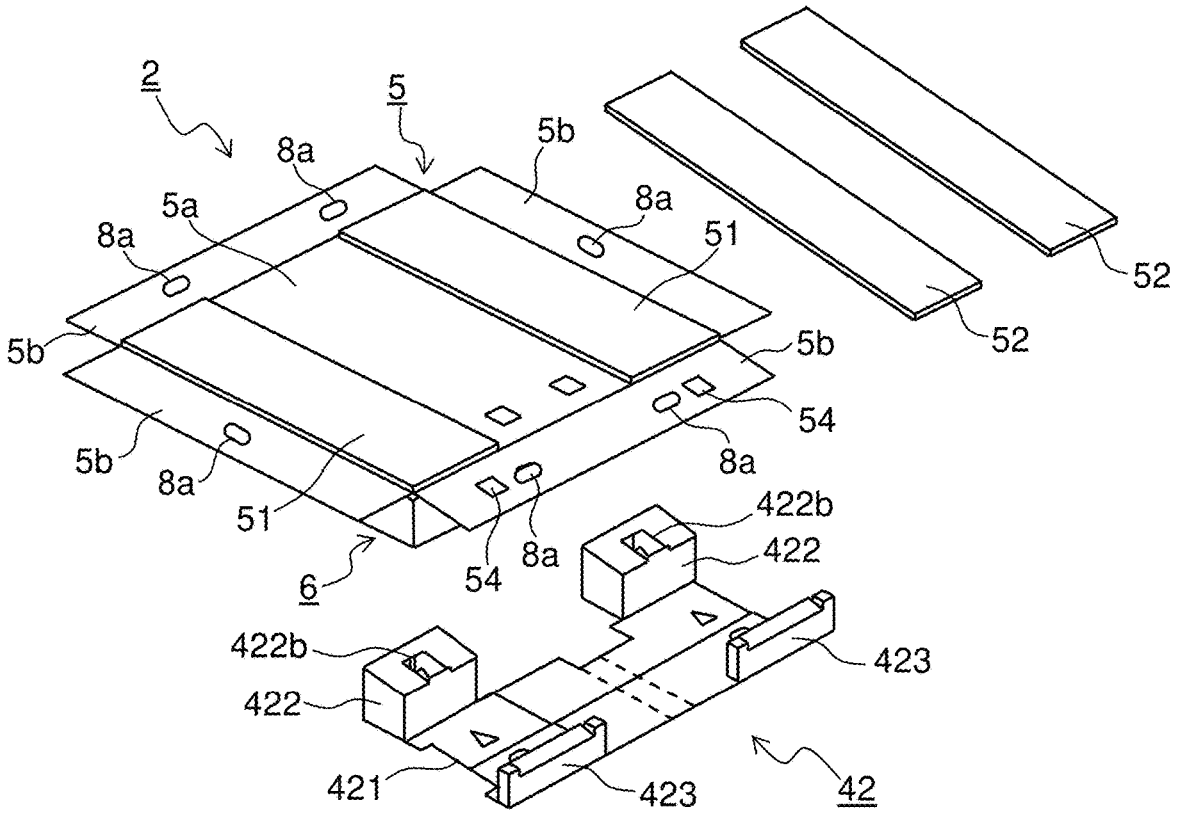
FIG. 15 is an exploded perspective view of a tray-fitted palette, slope plates, and the top cushion member placed under the slope plates in the packing container of the second embodiment.

FIG. 15 is an exploded perspective view of the tray-fitted palette 2, the slope plates 52, and the top cushion member 42 placed under the slope plates 52 in the packing container 1 of the second embodiment. As shown in FIG. 15, the flaps 5*b* of the tray 5 are collapsed outward. Then the top cushion member 42 folded up into the shape in FIG. 14 (second shape) is placed as a reinforcement stand under the slope plates 52. In this embodiment, in the flaps 5*b* of the tray 5, near the through holes 8*a*, positioning holes 54 are formed in which to fit the positioning projections 52*a* (see FIG. 4) on the slope plates 52.

Figure 16:
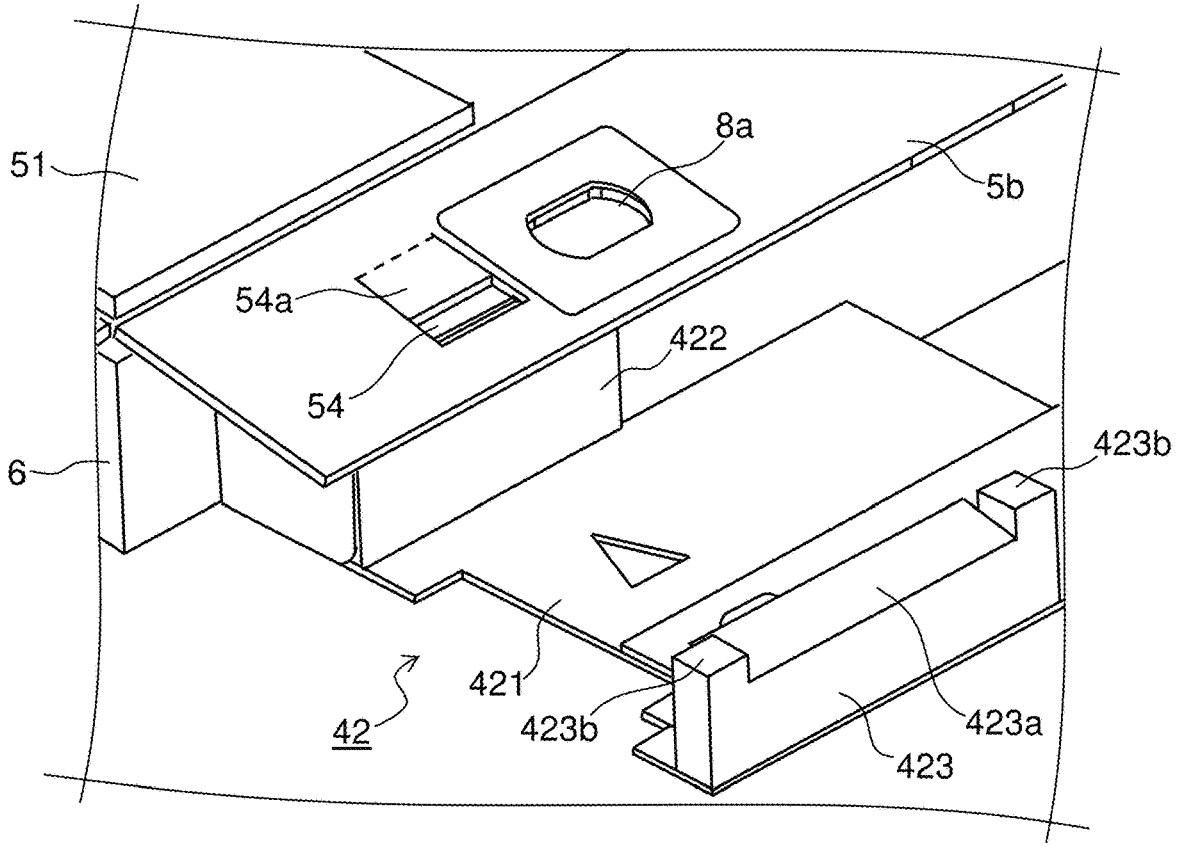
FIG. 16 is a part perspective view of a part of the packing container of the second embodiment where, when the slope plates are fitted to the tray, a flap is coupled to the top cushion member.
Figure 17:
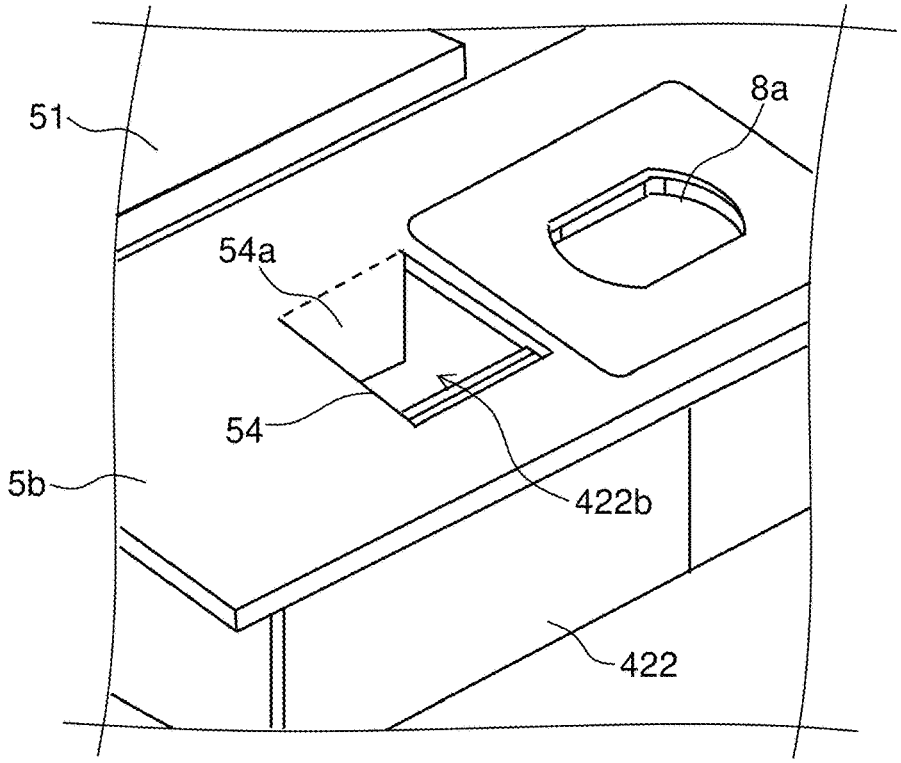
FIG. 17 is an enlarged view around a through hole and a positioning hole in FIG. 16.

FIG. 16 is a part perspective view of a part of the packing container 1 of the second embodiment where, when the slope plates 52 are fitted to the tray 5, a flap 5*b* is coupled to the top cushion member 42. FIG. 17 is an enlarged view around a through hole 8*a* and a positioning hole 54 in FIG. 16. As shown in FIG. 16, at the opening edge of the positioning hole 54, an insertion tab 54*a* is formed.

Next, as shown in FIG. 15, the positioning projections 52*a* on the slope plates 52 removed from the tray 5 are inserted into the positioning holes 54 in the flaps 5*b*. When this is done, as shown in FIG. 17, the insertion tab 54*a* is bent down so as to be inserted, along with the positioning projection 52*a*, into the opening 422*b* formed in the first column 422 of the top cushion member 42. Thus the flaps 5*b*, the slope plates 52, and the top cushion member 42 are positioned relative to each other.

Figure 18:
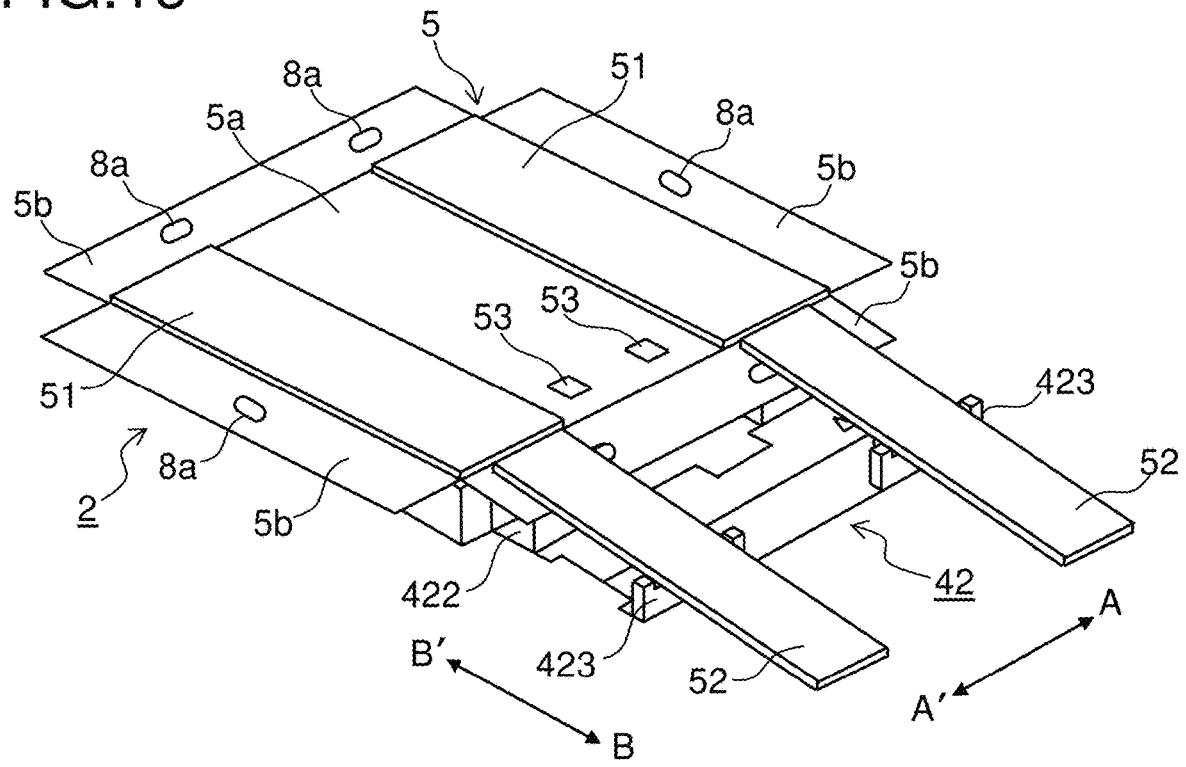
FIG. 18 is a perspective view of the packing container of the second embodiment, with the slope plates removed from the tray of the tray-fitted palette and coupled to a flap and the top cushion member placed under the slope plates.
Figure 19:
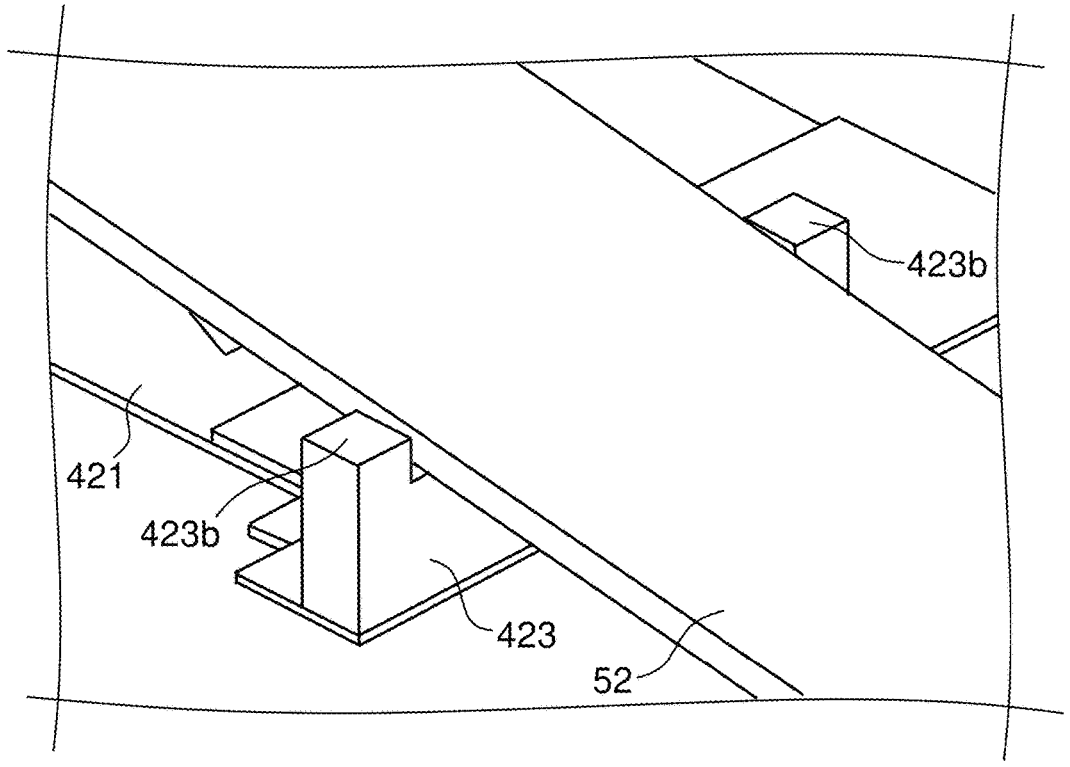
FIG. 19 is an enlarged perspective view of a part of FIG. 18 where the slope plate makes contact with a second column of the top cushion member.

In a manner as described above, a slope leading from the tray-fitted palette 2 to the floor level is ready. FIG. 19 is an enlarged perspective view of a part of FIG. 18 where the slope plate 52 makes contact with the second column 423 of the top cushion member 42.

As shown in FIG. 19, the slope plate 52 is held in a state fitted between the pair of guides 423*b* formed on the second column 423. The pair of guides 423*b* makes contact with opposite ends of the slope plate 52 in its width direction. This effectively suppresses displacement of the slope plate 52 in its width direction (arrow AA' direction).

With the structure of this embodiment, as with that of the first embodiment, it is possible to eliminate a member that is needed as a slope used only when the packing container 1 is unpacked. This helps reduce the amounts of materials collected and discarded from a used packing container 1 and is therefore environment-friendly. The slope plates 52 are packed in a state laid on the floor surface 5*a*. This eliminates also the need for a packing space for the slope plates 52. Engaging the positioning projections 52*a* on the slope plates 52 with the engagement holes 53 in the floor surface 5*a* helps prevent displacement or dropping-off of the slope plates 52.

In this embodiment, a single top cushion member 42 is used as a reinforcement stand for the slope plates 52. Thus the number of times that the top cushion member 42 and the tray 5 (flaps 5*b*) need to be positioned relative to each other is reduced to one, and this helps reduce working time. Moreover, the pair of first columns 422 and the pair of second columns 423 on the top cushion member 42 are incorporated in a single body. Thus the interval between the left and right slope plates 52 is constant, and this helps suppress displacement of the slope plates 52 relative to each other. It is thus possible to move the product P stably from the tray-fitted palette 2 to the floor level.

Forming the guides 423*b* on the second columns 423 permits stable holding of tip parts of the slope plates 52 where they tend to be displaced. It is thus possible to more effectively suppress displacement of the two slope plates 52 relative to each other.

Fitting the positioning projections 52*a* on the slope plates 52 into the positioning holes 54 formed in the flaps 5*b* of the tray 5 and fitting them, along with the insertion tabs 54*a* formed at the opening edges of the positioning holes 54, into the openings 422*b* formed in the first columns 422 of the top cushion member 42, it is possible to easily and reliably position the slope plates 52 relative to the tray 5 and the top cushion member 42.

In this embodiment, when the top cushion member 42 is used as a reinforcement stand for the slope plates 52, as shown in FIG. 14, the cushion plate 421 is in a state unfolded in the first direction (arrow AA' direction). Instead, for example, from the state in FIG. 12 (first shape), the cushion plate 421 can be as it is folded up along the folding lines L1 and L2 so that, as shown in FIG. 20, the cushion plate 421 is in a state folded-up in the first direction along the folding lines L3 and L4.

Figure 20:
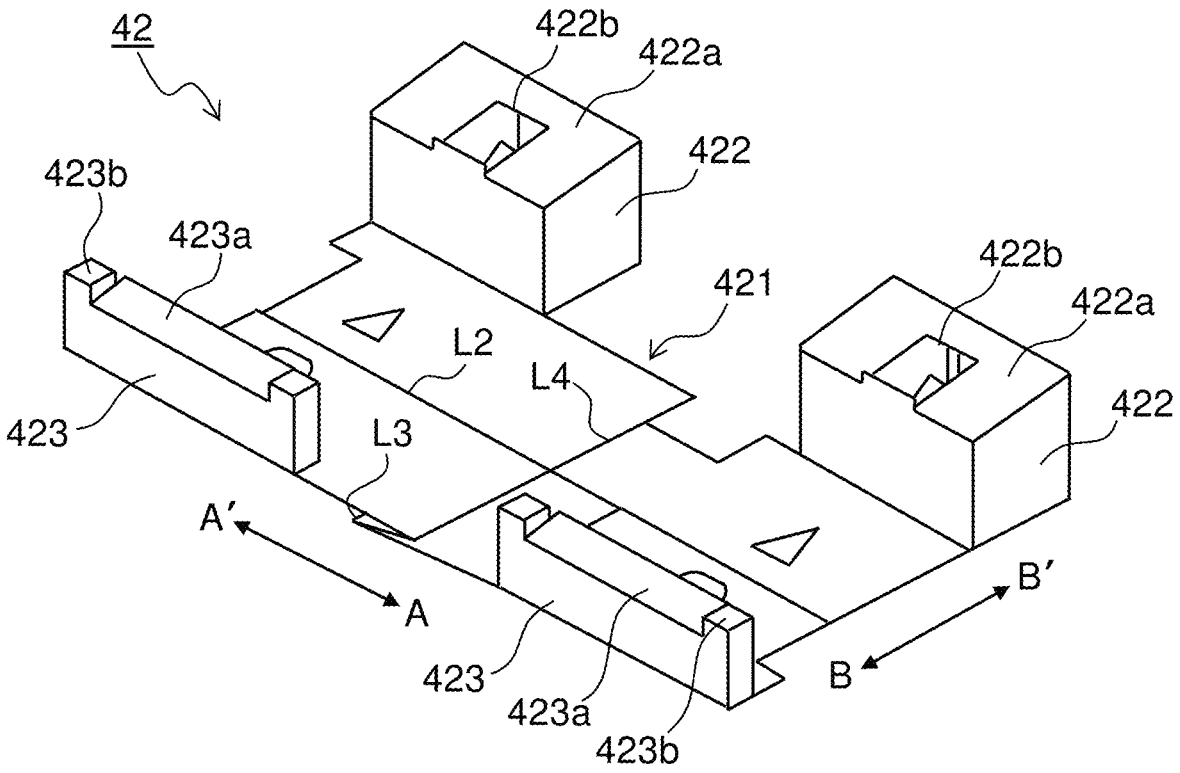
FIG. 20 is a perspective view of the top cushion member placed, in a state folded up along folding lines, under the slope plates in the packing container of the second embodiment.

That is, choosing between the state in FIG. 14 and the state in FIG. 20 permits the interval between the pair of first columns 422 and the interval between the pair of second columns 423 to be adjusted in two steps according to the interval between the slope plates 52 (the positions of the casters 60 of the product P).

The present disclosure can be implemented in any manners other than specifically described by way of embodiments above and allows for many modifications without departure from the spirit of the present disclosure. For example, while the embodiments described above deal with examples where the top cushion member 42 is used as a reinforcement stand for the slope plates 52, this is not meant as any limitation: the side cushion member 41 may be used as a reinforcement stand for the slope plates 52.

While in the first embodiment described above the two cushion members 42 are given the same shape, so long as the relationship between the first and second columns 422 and 423 is the same, the two cushion members 42 may be given different shapes. The folding lines L1 and L2 formed on the cushion plate 421 in the first and second embodiments or the folding lines L3 and L4 formed on the cushion plate 421 in the second embodiment can be moved to any other positions so that the top cushion member 42 can be folded up so as to suit the shape of the product P or the size or inclination of the slope plates 52.

While in the embodiments described above the reinforcement member 427 is arranged inside the first column 422 of the top cushion member 42, the reinforcement member 427 may be arranged, instead of or in addition to inside the first column 422, inside the second column 423 or the third column 424.

The present disclosure finds application in packing containers comprising a tray-fitted palette and a top box. According to the present disclosure, it is possible to provide a packing container that can co-pack a slope for moving a packed article and that helps suppress an increase in the size of, or the amounts of materials used in, the packing container.

What is claimed is:

1. A packing container comprising:

a tray-fitted palette including:

a tray on which a packed article is placed; and a palette fixed to a bottom surface of the tray;

a top case in a shape of a tube open at a bottom, the top case covering a side face and a top face of the packed article;

a cushion member placed between the packed article and the top case; and a slope plate coupled to the tray-fitted palette when the packed article placed on the tray is moved, wherein the cushion member is arranged as a reinforcement stand under the slope plate coupled to the tray-fitted palette.

2. The packing container according to claim 1, wherein the tray has a rectangular floor surface and flaps provided contiguously with four sides of the floor surface, the flaps have a positioning hole formed therein in which a positioning projection formed on the bottom surface of the slope plate are inserted, and engaging the positioning projection with the positioning hole permits the slope plate to be positioned relative to the palette.

3. The packing container according to claim 2, wherein the cushion member has an opening formed therein at positions overlapping with the positioning hole, and inserting the positioning projection via the positioning hole into the opening permits the slope plate to be positioned relative to the tray-fitted palette and the cushion member.

4. The packing container according to claim 3, wherein at an opening edge of the positioning hole, an insertion tab is formed that is together with the positioning projection inserted in the opening.

5. The packing container according to claim 2, wherein the flaps have through holes formed therein in which fastening members for fixing together the tray-fitted palette and the top case are inserted, and the through holes serve also as the positioning hole.

6. The packing container according to claim 2, wherein the slope plate is packed in a state laid on the floor surface of the tray, and the positioning projections engage with engagement holes formed in the floor surface.

7. The packing container according to claim 6, wherein the tray has a pair of support plates that is laid on the floor surface along opposite two sides of the floor surface and that bears a load of the packed article, and the slope plate is laid on the floor surface contiguously between the pair of support plates such that a top surface of the slope plate and a top surface of the support plates are flush with each other.

8. The packing container according to claim 1, wherein the cushion member includes:

a cushion surface in a shape of a flat plate; and a plurality of columns including a first column and a second column provided contiguously with opposite edges of the cushion surface, when, in a state where the cushion member is arranged as the reinforcement stand under the slope plate, a horizontal direction orthogonal to an extension direction of the slope plate is a first direction and a horizontal direction orthogonal to the first direction is a second direction, brining the cushion surface either into a state folded up along a first folding line parallel to the first direction or into a state unfolded from folded-up state permits the cushion member to change shapes between a first shape in which an interval between the first and second columns is set to suit a shape of the packed article and a second shape in which the interval between the first and second columns is set to suit use as the reinforcement stand for the slope plate.

9. The packing container according to claim 8, wherein at tip ends of the first and second columns, inclined surfaces are formed that incline in a same direction, and an inclination angle of the inclined surfaces is equal to an inclination angle of the slope plate in a state coupled to the tray-fitted palette.

10. The packing container according to claim 8, wherein the plurality of columns include a third column provided orthogonally to and contiguously with the first and second columns, and when the cushion member is arranged as the reinforcement stand under the slope plate, the third column is arranged along a side edge of the slope plate and part of the third column protrudes upward beyond the slope plate.

11. The packing container according to claim 8, wherein when the packed article is moved, a pair of the slope plates are, with a predetermined interval therebetween, coupled to one side of the tray-fitted palette, and the cushion member includes:

a pair of the first columns and a pair of the second columns that, when the cushion member is arranged as the reinforcement stand under the slope plate, support the pair of the slope plates respectively; and one cushion surface as the cushion surface that couples together the pair of the first columns and the pair of the second columns.

12. The packing container according to claim 11, wherein bringing the cushion surface either into a state folded-up along a second folding line parallel to the second direction or into a state unfolded from the folded-up state permits the cushion member to adjust an interval between the pair of the first columns and an interval between the pair of the second columns to suit the predetermined interval.

13. The packing container according to claim 11, wherein the cushion member has a pair of guides formed thereon that protrudes upward beyond the second column to make contact with opposite sides of the slope plate in a width direction thereof.

14. The packing container according to claim 8, wherein at least one of the plurality of columns has a reinforcement member arranged therein that is formed by stacking together a plurality of cardboard sheets, and the reinforcement member is arranged such that a grain direction of the cardboard sheets runs in a vertical direction.

* * * * *